US005323563A

United States Patent [19]

Rogers et al.

[11] Patent Number: 5,323,563

[45] Date of Patent: Jun. 28, 1994

[54] RETRACTABLE LOCATORS FOR DECK PANELS OF PORTABLE STAGING

[75] Inventors: Orley D. Rogers, Farwell; Kenneth E. Staten, Clare, both of Mich.

[73] Assignee: Stageright Corporation, Clare, Mich.

[21] Appl. No.: 923,714

[22] Filed: Jul. 31, 1992

[51] Int. Cl.[5] ..... E04H 3/28

[52] U.S. Cl. ..... 52/7; 52/126.6; 52/263

[58] Field of Search ..... 52/126.6, 126.5, 508, 52/481, 480, 479, 7; 248/188; 403/170, 174, 178, 246

[56] References Cited

U.S. PATENT DOCUMENTS 4,602,012 7/1952 Doty .
2,669,117 2/1954 Fuhrmann .
2,978,754 4/1961 Wilson .
3,354,596 11/1967 Schafer .
4,599,010 7/1986 Hocking ..... 403/246
4,638,604 1/1987 Rogers et al. .

FOREIGN PATENT DOCUMENTS 3114590 10/1982 Fed. Rep. of Germany .
1340185 12/1973 United Kingdom .
1432075 4/1976 United Kingdom .

*Primary Examiner*—Michael Safavi
*Attorney, Agent, or Firm*—Barnes, Kisselle, Raisch, Choate, Whittemore & Hulbert

[57] ABSTRACT

A staging system for construction of a portable performance stage having support units for supporting one or more of the deck panels. The support units having two or more, and preferably four, panel locator pins. One of the locator pins is a stationary pin. The others are capable of being pivoted to a retracted position.

11 Claims, 5 Drawing Sheets

RETRACTABLE LOCATORS FOR DECK PANELS OF PORTABLE STAGING

FIELD OF INVENTION

Retractable locators for deck panels in portable stage platforms for use by musical groups and for dramatic presentations.

BACKGROUND AND FEATURES OF THE INVENTION

Portable staging is often composed of deck panels arranged edge-to-edge and supported on vertical legs. In accordance with this invention, the legs are provided with support units having two or more locator pins. One of the locator pins is preferably stationary and the rest are retractable. In a preferred embodiment, there is one upright locator pin which is stationary and three additional pins which may be individually shifted from an upright position to a retracted position. When upright, each pin engages and locates a deck panel. In a single deck panel configuration, only the stationary pin is upright. One or more additional locator pins may be shifted to upright position as needed to locate adjacent deck panels.

It is an object of the invention to support one or more deck panels in a platform stage by an arrangement of locator pins having the foregoing features.

Other objects, features and advantages of the invention will be apparent in the following specification and claims in which the invention is described together with details to enable persons skilled in the art to practice the invention, all in connection with the best mode presently contemplated for the invention.

DETAILED DESCRIPTION OF THE INVENTION AND THE MANNER OF USING IT

Figure 1:
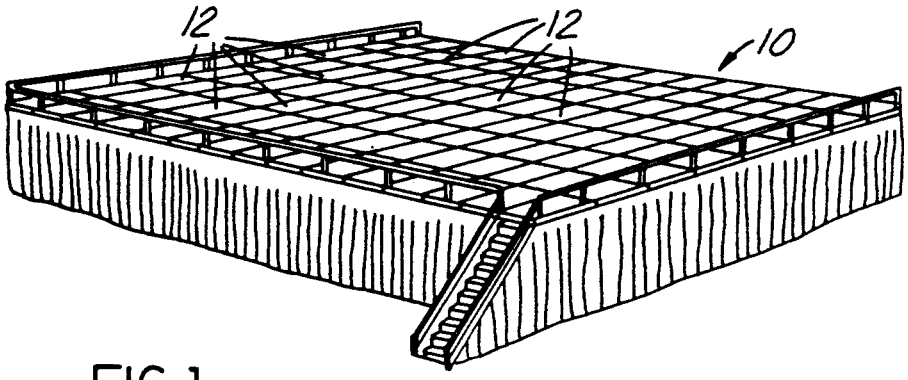
FIG. 1 is a perspective view of a portable stage having deck panels arranged in a common plane, in which the deck panels are adapted to be supported by the apparatus of this invention.

FIG. 1 illustrates a portable stage 10 having a plurality of rectangular deck panels 12 arranged edge-to-edge in a common horizontal plane. The deck panels may be supported on support units 14 mounted on legs 16 as shown in FIG. 2–6.

The support unit 14 comprises a base 17 having a flat horizontal plate 18 secured to the top of a frame 20, and is mounted on the upper end of a vertical leg 16 by any suitable means. The leg 16 is one of many which may support the deck panels a predetermined distance above the ground or other supporting surface.

The support unit 14 has locator pins 22, 24, 26 and 28. The pin 22 is a stationary pin mounted on the plate 18 in a fixed position projecting vertically upwardly. Pin 22 is upwardly tapered and is adapted to engage in a hole 30 in one of the panels.

Pins 24, 26 and 28 are retractable and each has a body portion 32 and an upwardly tapered end portion 34. The retractable pins 24, 26 and 28 are mounted on horizontal pivot pins 35 which extend across elongate individual pockets or recesses 36 in the frame 20. The plate 18 has slots 37 over the pockets so that the locator pins can pivot from a retracted position within the pockets shown in FIG. 5 to a vertically upwardly extending operative position shown in FIG. 6.

A spring pressed ball 38 mounted in a holder in the bottom of each pocket engages in a depression 39 in the bottom of each retractable pin to releasably hold it upright.

Figure 2:
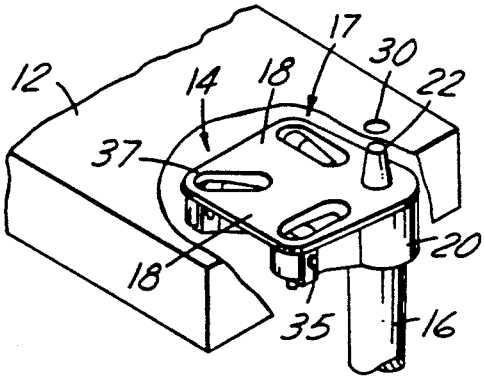
FIG. 2 is a perspective view showing a support unit with locator pins supported on the upper end of a leg or riser, only one of the locator pins being in the upright position in a single deck panel configuration.
Figure 3:
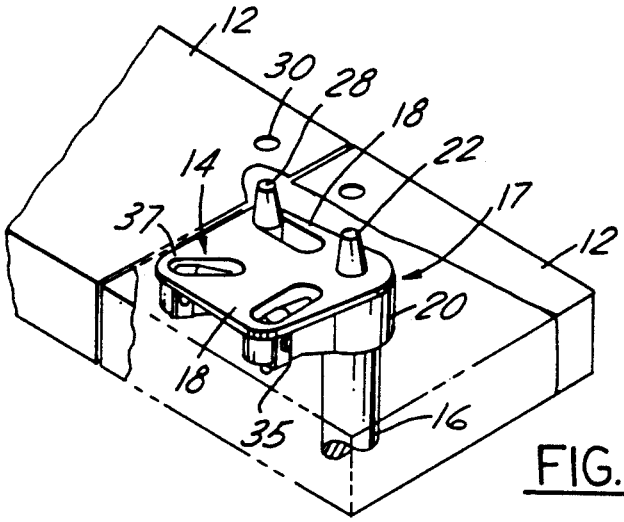
FIG. 3 is a perspective view showing two locator pins in the upright position, in a dual deck panel configuration.
Figure 4:
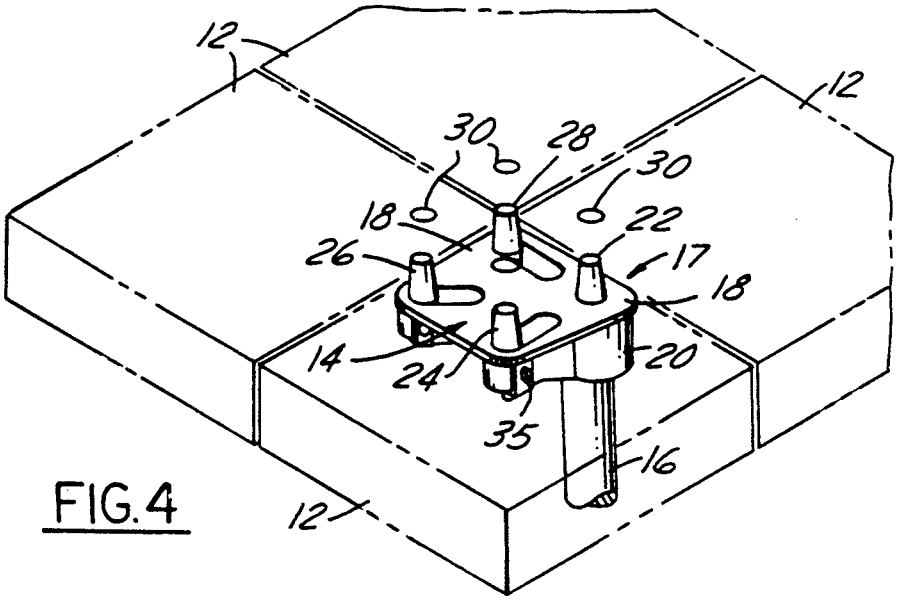
FIG. 4 is a perspective view in which all four locator pins are shown in the upright position, in a quad deck panel configuration.
Figure 5:
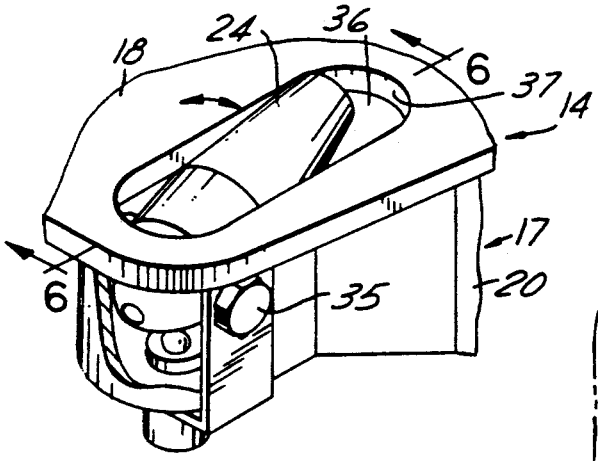
FIG. 5 is an enlarged fragmentary perspective view showing one of the retractable locator pins in retracted position.
Figure 6:
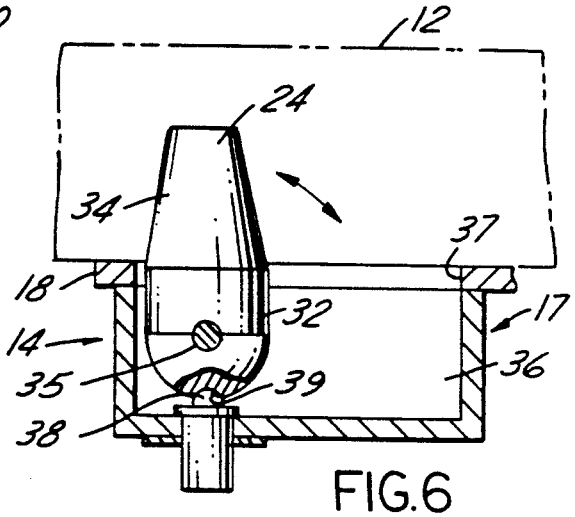
FIG. 6 is a sectional view taken on the line 6—6 in FIG. 5 but with the locator pin upright.

When the retractable locator pins 24, 26, and 28 are in the vertically upwardly extending position, their tapered portions are adapted to extend into holes 30 in the deck panels to properly locate them. In FIG. 2, the retractable pins 24, 26 and 28 are in their retracted positions below the top plate 18 so that only the stationary pin 22 projects upwardly for locating a deck panel. FIG. 3 shows a dual configuration in which one of the retractable pins together with the stationary pin project upwardly for locating two adjacent deck panels. FIG. 4 shows all four pins in the upright position for locating four adjacent deck panels. It will be noted in FIG. 4 that the four locator pins when in the upright position are spaced apart equally in a square pattern.

Figure 8:
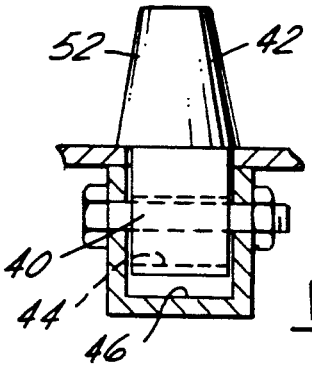
FIG. 8 is a sectional view taken on the line 8—8 in FIG. 7.
Figure 9:
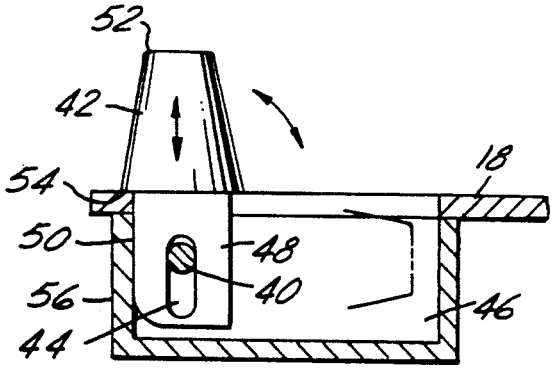
FIG. 9 is a sectional view taken on the line 9—9 in FIG. 7 but showing the locator pin upright.
Figure 7:
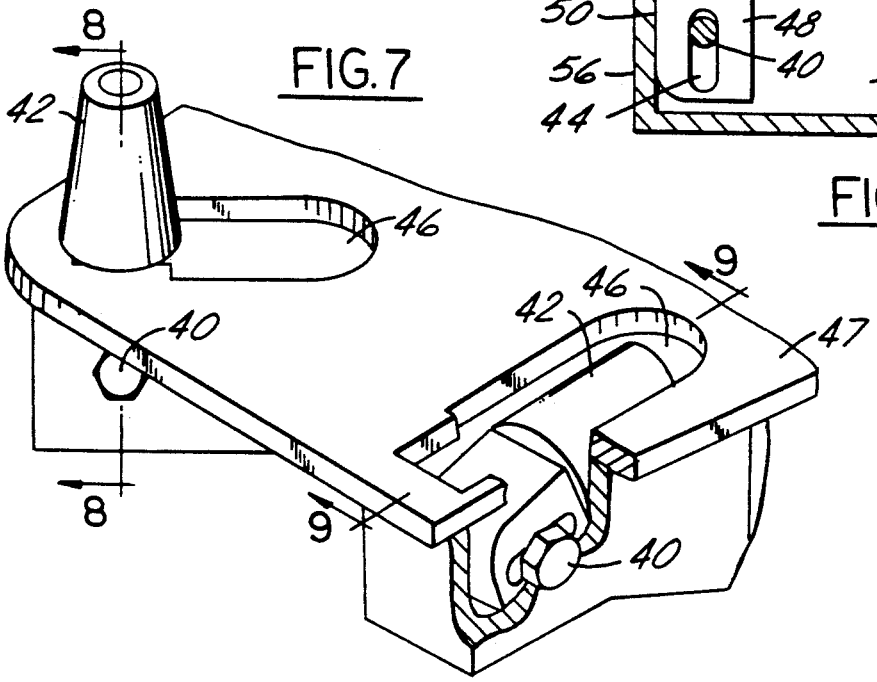
FIG. 7 is a perspective view of a support unit having retractable locator pins of modified construction, one of the pins being shown in the upright position and the other in retracted position.

FIGS. 7–9 show a modification of the invention in which a horizontal pivot pin 40 for supporting a retractable locator pin 42 extends across the elongate, open top pocket or recess in base 47 and through a slot 44 in the locator pin. The slot is elongated lengthwise of the locator pin. The locator pin can turn from the retracted position shown at the right in FIG. 7 in which it is disposed within the pocket or recess 46 to the upright position at the left in FIG. 7 and also in FIG. 9 in which it projects through the open top of the pocket above the base. The pin and slot connection facilitates movement of the locator pin between upright and retracted positions without interference with the pocket end walls. The locator pin has a body portion 48 provided with a flat side 50 which extends lengthwise thereof. It also has an upwardly tapering conical end portion 52 which at its large end overlaps the body portion to form an annular shoulder 54. In the upright position, this shoulder 54 rests upon the top plate 18 of base 47 and the flat side 50 of the body portion bears against a vertical wall 56 of the pocket, thereby holding the pin upright.

Figure 10:
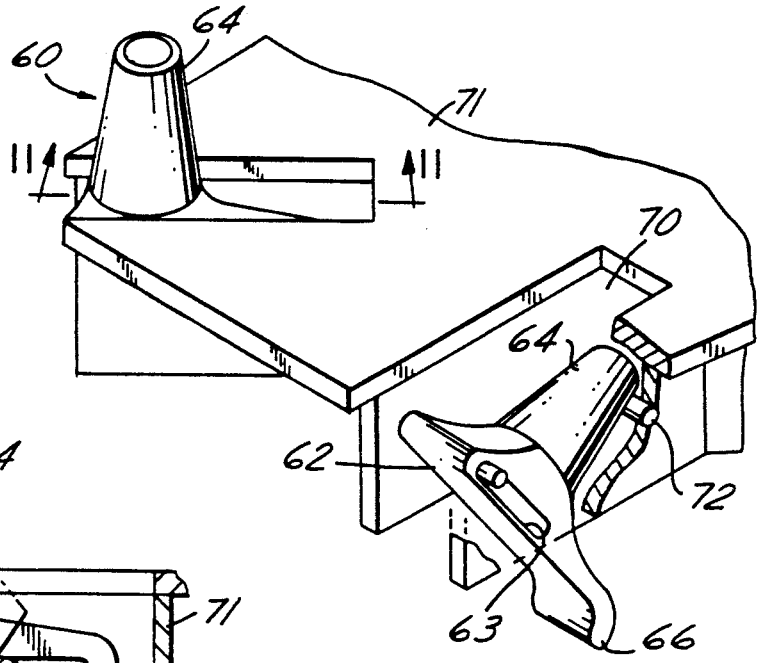
FIG. 10 is a fragmentary view in perspective of a further modification, showing one locator pin retracted and the other upright.
Figure 11:
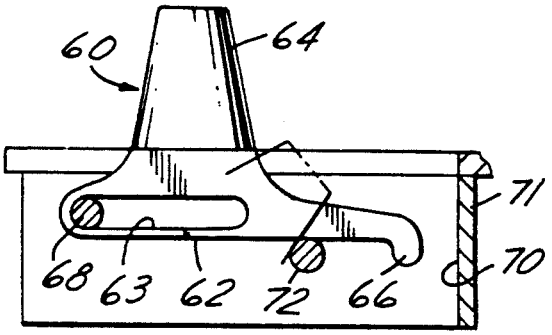
FIG. 11 is a sectional view taken on the line 11—11 in FIG. 10.

Referring to the modification in FIGS. 10 and 11, the retractable locator pin 60 has an elongate flat plate portion 62 and a tapered pin portion 64 near one end which projects away from the plate portion. The plate portion 62 has an elongate slot 63 near the end from which the pin portion projects and a turned-down flange 66 at the other end. A pivot pin 68 mounted in the walls of the elongate, open top pocket or recess 70 in base 71 extends across the pocket and through the slot. A support bar 72 spaced from the pivot pin 68 extends across the pocket. The bottom and one end of the pocket is open. The retractable locator pin in the FIG. 11 position in which the pin portion 64 is upright, rests on the support bar 72. The locator pin may be retracted by sliding it to the left in FIG. 11, at the same time raising the flange 66 over the support bar 72, and then dropping the locator pin to the FIG. 10 position in which the pin portion 64 rests on the support bar 72 (see dotted lines in FIG. 11).

Figure 13:
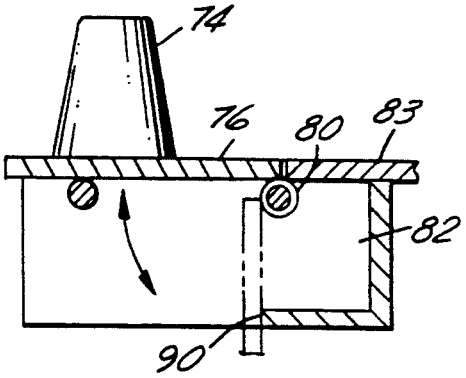
FIG. 13 is a sectional view taken on the line 13—13 in FIG. 12.
Figure 12:
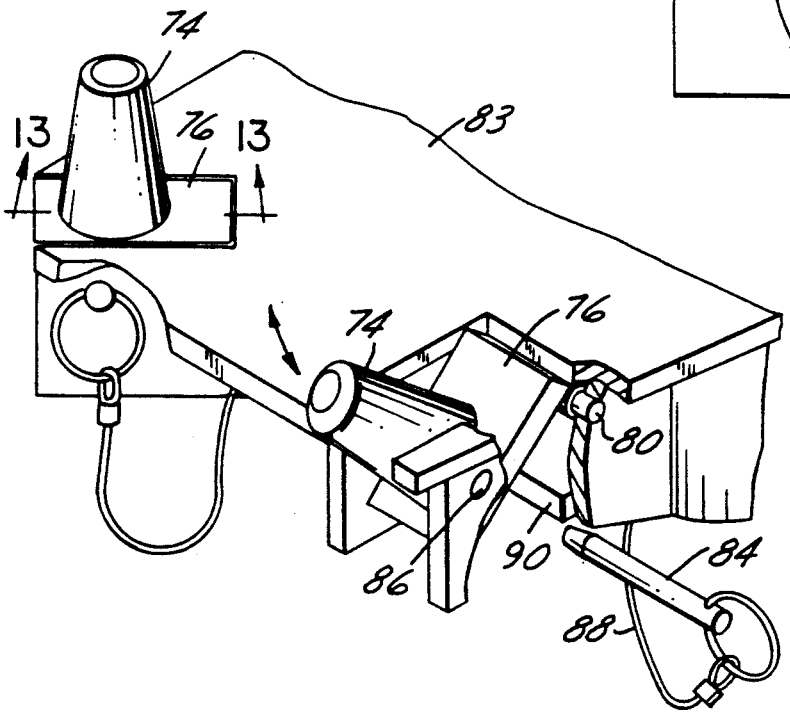
FIG. 12 is a fragmentary perspective view of a further modification, showing one locator pin in the upright position and the other in retracted position.

In the modification of FIGS. 12 and 13, the retractable locator pin 74 is an upwardly tapering member fixedly mounted on a plate 76 which is hinged at one end on a pivot pin 80 extending across one end of the elongate, open top pocket or recess 82 of base 83. The pin may be held upright by a locking pin 84 extending through aligned holes 86 in the side walls defining the pocket. This locking pin 84 extends across the pocket and supports the plate 76 in horizontal position so that the locator pin 74 is upright. For convenience, the locking pin may be attached to the base 83 by a cord 88. To retract the locator pin 74, the locking pin 84 is withdrawn as in FIG. 12, allowing the locator pin 74 and plate 76 to pivot by their own weight down beneath the top surface of the base to a retracted position in which the plate is substantially vertical as shown in dot dash lines in FIG. 13. The bottom and one end of the pocket is cut away to enable the locator pin to fully retract and to provide an abutment 90 which the plate 76 contacts when retracted.

FIGS. 5–13 show various modifications of the retractable locator pin construction. It will be understood that in most cases all of the retractable locator pins on a given support unit will be of the same construction which may be any one of those constructions shown and described herein.

FIGS. 14–19 show a further modification. As there shown, a supporting leg unit 100 is provided composed of two vertical legs 102 and 104 rigidly connected by braces 105. Each leg has a lower tubular section 106 and an upper section 108 telescoped within the lower section. A locking pin 110 may be inserted through a hole 112 in the lower leg section of any one of a series of longitudinally spaced holes 114 in the upper leg section to lock the upper leg section at a given elevation.

A support unit 116 is associated with each leg. These support units in this instance are of identical construction. Each comprises a frame 118 having a tubular portion 120 sleeved over an upper leg section 108 and locked thereto by a locking pin 122 adapted to be inserted in a hole 123 in the tubular portion 120 and in one of the holes 114 in the upper section of the leg. In most cases both support units will be supported at the top of the legs as shown at the left in FIG. 14, but FIG. 14 shows the support unit at the right in a lower position to allow for a variable rise system.

Figure 17:
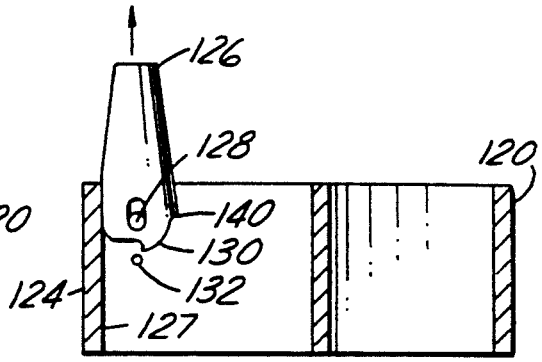
FIGS. 17–19 are similar to FIG. 16 but show the retractable locator pin in different positions.
Figure 18:
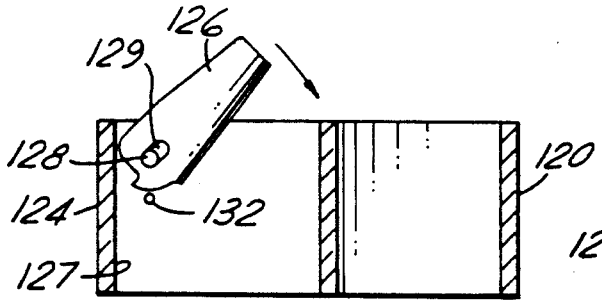
Figure 19:
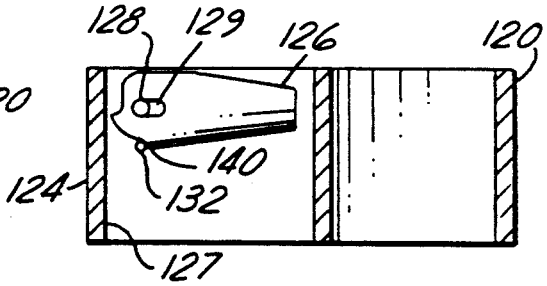

Each support 116 unit also has three sections 124 radiating from the tubular portion 120 to accommodate retractable tapered locator pins 126. Each section 124 forms an elongate pocket or recess 127 which is open at the top. A horizontal pivot pin 128 extends across each pocket near the outer end. This pivot pin extends through an elongate slot 129 in the bottom of the locator pin. The base of the locator pin has a projection 130 adapted to hook over a transverse stop pin 132 which is beneath the pivot pin and, in cooperation with the outer wall 134 of the pocket which engages the body of the locator pin when upright, holds the locator pin in an upright position extending above the pocket and into a hole in a panel to be located. The locator pin may be rotated from locked position to a position within the pocket by elevating it as shown in FIG. 17 and then turning it to a horizontal position as shown in FIGS. 18 and 19. In the fully stored position of FIG. 19, a second projection 140 at or near the base of the locator pin engages the stop pin 132 to prevent further downward pivoting.

Figure 14:
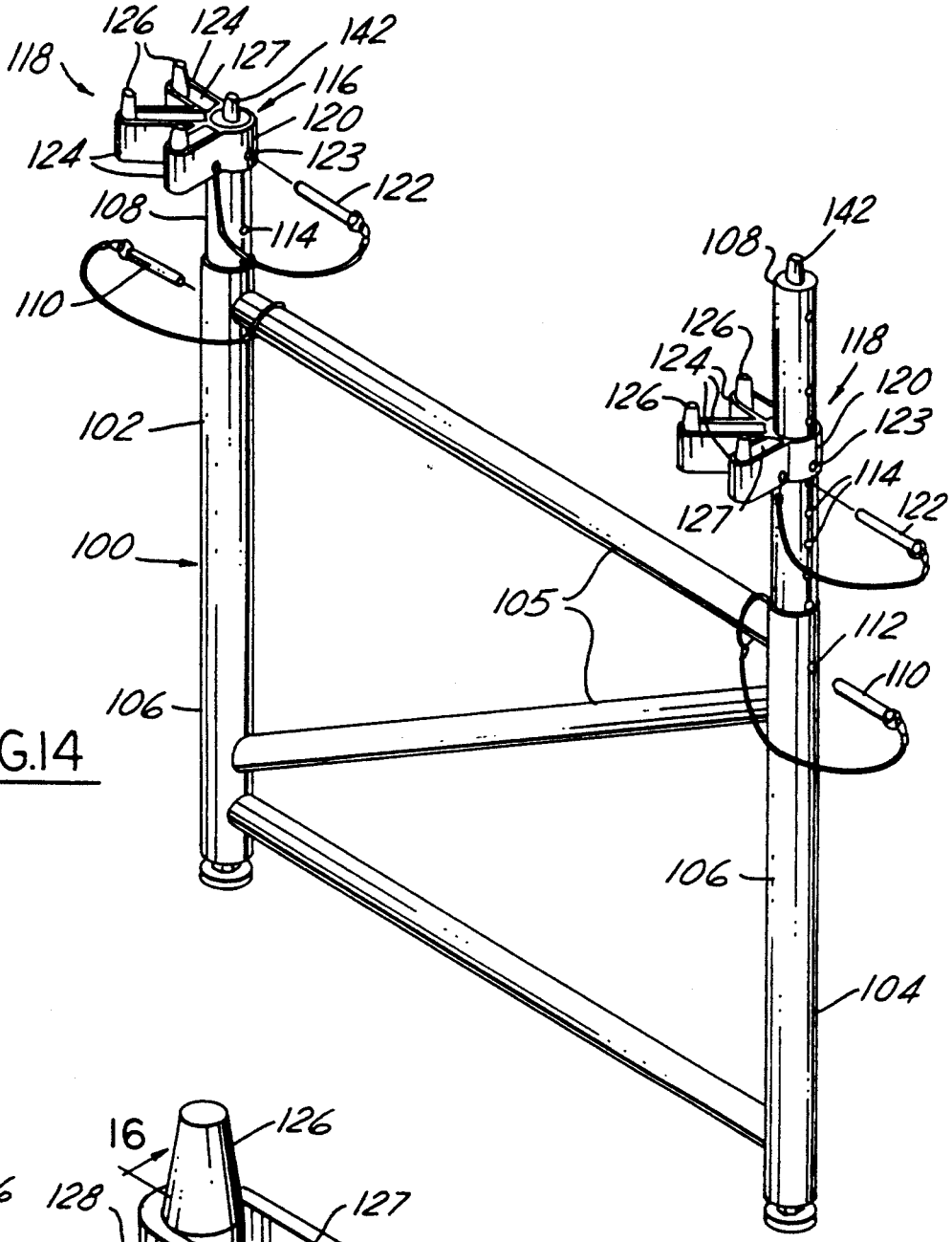
FIG. 14 is a perspective view of still another modification.
Figure 15:
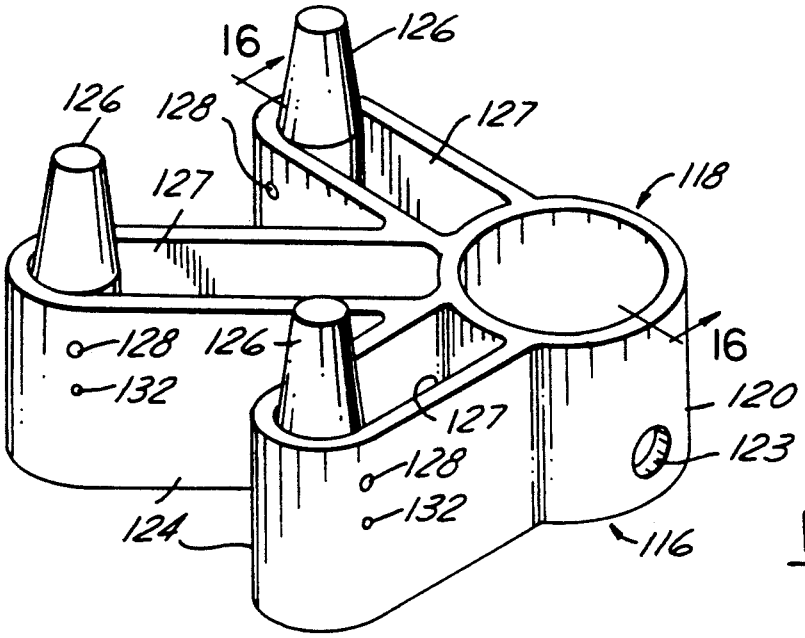
FIG. 15 is a perspective view of one of the support units in FIG. 14.
Figure 16:
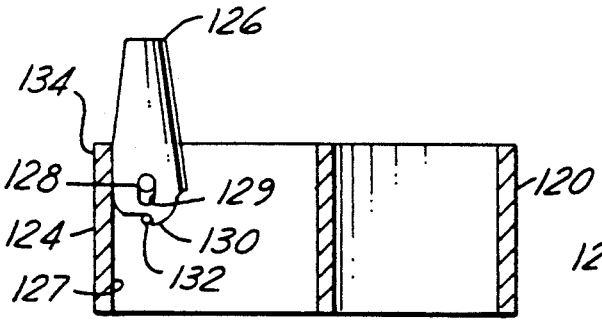
FIG. 16 is a sectional view taken on the line 16—16 in FIG. 15.

In this construction, the tapered stationary pin 142 is affixed to the top of each upper leg section 108 and projects through the tubular portion 120 of the support unit when the support unit is at the top of the leg as shown in FIG. 14. When the three retractable pins 126 are in the upright position shown in FIG. 14, they together with the stationary pin 142 form a square configuration.

As stated above, in order to allow for a variable rise system, one of the support units may be supported at a lower level, as seen at the right in FIG. 14. In a system in which all of the deck panels are on the same level, both support units are preferably locked to the top of the upper section of the leg. Obviously the entire deck structure may be raised or lowered by raising or lowering the upper section of each leg.

What is claimed is:

1. In a staging system for construction of portable performance stages having a plurality of deck panels, apparatus for supporting one or more deck panels comprising:

a. a panel support unit having a base, b. a first locator pin projecting upwardly from said base to engage and locate a first deck panel, c. at least one additional locator pin mounted on said base for movement from a retracted position to an upwardly projecting position spaced from said first locator pin to engage and locate a second deck panel, d. an elongate, upright leg, means for connecting said support unit to said leg in vertically adjusted position, e. said base having a recess for receiving said additional locator pin in its retracted position, f. said additional locator pin being pivoted to said base, g. and means for releasably holding said additional locator pin in its upright position comprising a stop in said recess engageable with a projection on said additional locator pin together with a side wall of said recess engageable with a side wall of said locator pin.

2. Structure as defined in claim 1, and further including a second projection on said additional locator pin engageable with said stop to releasably hold said additional locator pin in its retracted position.

3. Structure as defined in claim 2, wherein said base has an opening, said first locator pin projecting upwardly from the upper end of said leg and said leg extending upwardly through said opening in said base, and means connecting said base to said leg.

4. Structure as defined in claim 3, wherein said leg is composed of telescoping leg sections, and means for releasably locking said leg sections in adjusted position to vary the length of said leg.

5. In a staging system for construction of portable performance stages having a plurality of deck panels, apparatus for supporting one or more deck panels comprising:

a. a panel support unit having a base;
b. a first locator pin projecting upwardly from said base to engage and locate a first deck panel,
c. at least one additional locator pin mounted on said base for movement from a retracted position to an upwardly projecting position spaced from said first locator pin to engage and locate a second deck panel,
d. an elongate, upright leg having an upper end, said base having an opening, said first locator pin projecting upwardly from the upper end of said leg and said leg extending upwardly through said opening in said base, and means for connecting said base to said leg.

6. In a staging system for construction for portable performance stages having a plurality of deck panels, apparatus for supporting one or more deck panels comprising:

a. a panel support unit having a base,
b. a first locator pin projecting upwardly from said base to engage and locate a first deck panel,
c. at least one additional locator pin mounted on said base for movement from a retracted position to an upwardly projecting position spaced from said first locator pin to engage and locate a second deck panel,
d. said additional locator pin being pivoted to said support unit,
e. and spring means for releasably retaining said additional locator pin in said upwardly projecting position.

7. Structure as defined in claim 6, wherein said base has a recess for receiving said additional locator pin in its retracted position.

8. In a staging system for construction of portable performance stages having a plurality of deck panels, apparatus for supporting one or more deck panels comprising:

a. a panel support unit having a base,
b. a first locator pin projecting upwardly from said base to engage and locate a first deck panel,
c. at least one additional locator pin mounted on said base for movement from a retracted position to an upwardly projecting position spaced from said first locator pin to engage and locate a second deck panel,
d. said base having a recess for receiving said additional locator pin in its retracted position,
e. said additional locator pin being pivoted to said base by a pivot pin extending through a slot in said additional locator pin,
f. said slot being elongated to permit said locator pin to move from said retracted to said upwardly projecting position without interference with said recess,
g. and a stop extending across said recess adapted to support said locator pin in said upwardly projecting position.

9. Structure as defined in claim 8, wherein said additional locator pin has a plate portion provided with a flange extending over said stop.

10. In a staging system for construction of portable performance stages having a plurality of deck panels, apparatus for supporting one or more deck panels comprising:

a. a panel support unit having a base,
b. a first locator pin projecting upwardly from said base to engage and locate a first deck panel,
c. at least one additional locator pin mounted on said base for movement from a retracted position to an upwardly projecting position spaced from said first locator pin to engage and locate a second deck panel,
d. said base having a recess for receiving said additional locator pin in its retracted position,
e. and a removable lock pin extending across said recess to support said additional locator pin in its retracted position.

11. In a staging system for construction of portable performance stages having a plurality of deck panels, apparatus for supporting one or more deck panels comprising:

a. a panel support unit having a base,
b. a first locator pin projecting upwardly from said base to engage and locate a first deck panel,
c. at least one additional locator pin mounted on said base for movement from a retracted position to an upwardly projecting position spaced from said first locator pin to engage and locate a second deck panel,
d. said base having a recess for receiving said additional locator pin in its retracted position,
e. said locator pin being pivoted to said base,
f. and means for releasably holding said additional locator pin in its upright position comprising a stop in said recess engageable with a projection on said additional locator pin together with a side wall of said recess engageable with a side wall of said locator pin.

* * * * *